US008209776B1

(12) United States Patent
Aragon et al.

(10) Patent No.: US 8,209,776 B1
(45) Date of Patent: Jul. 3, 2012

(54) HYGIENIC SPORTS GRIPPING BAND

(76) Inventors: Virgil R. Aragon, Pueblo, CO (US); Kenneth R. Aragon, Pueblo, CO (US); Troy T. Aragon, Pueblo, CO (US)

( * ) Notice: Subject to any disclaimer, the term of this patent is extended or adjusted under 35 U.S.C. 154(b) by 255 days.

(21) Appl. No.: 12/655,371

(22) Filed: Dec. 30, 2009

Related U.S. Application Data

(63) Continuation-in-part of application No. 11/895,575, filed on Aug. 27, 2007, now abandoned.

(51) Int. Cl.
*A41D 20/00* (2006.01)

(52) U.S. Cl. ..... 2/170; 2/16; 2/20; 2/162; 2/917

(58) Field of Classification Search ..... 2/16, 20, 2/162, 170, 917; 118/270
See application file for complete search history.

(56) References Cited

U.S. PATENT DOCUMENTS 247,033 A * 9/1881 Fisher ..... 118/201
1,190,905 A * 7/1916 Jasper et al. ..... 222/180
2,438,037 A * 3/1948 Chapman ..... 118/201
2,490,650 A * 12/1949 Reckler ..... 118/270
2,658,474 A * 11/1953 Sengbusch et al. ..... 118/270
5,318,371 A * 6/1994 Niewulis ..... 401/6
2006/0117458 A1 * 6/2006 Ishihara et al. ..... 2/170

* cited by examiner

*Primary Examiner* — Alissa Tompkins
(74) *Attorney, Agent, or Firm* — G. F. Gallinger

(57) ABSTRACT

Transmission of communicable diseases has been a long standing problems between athletes playing team sports. The potential of HIV and AIDS virus transmission has elevated this problem to be a grave concern. A major avenue for the transmission of infectious agents has been identified to be a game's ball. In many sports it is common practice for athletes to wet their finger tips to better grip the ball. A hygienic method of improving grip on a game ball is disclosed. The disclosed gripping band is wholly flexible and accordingly is not a potential source of injury even in a contact sport. Wetted absorbent material within a water tight pan, due to minimally exposed surface area, remains moist for sustained periods in any orientation.

10 Claims, 1 Drawing Sheet

HYGIENIC SPORTS GRIPPING BAND

PRIOR APPLICATION

This application is filed as a Continuation-In-Part of U.S. patent application Ser. No. 11/895,575 filed Aug. 27, 2007 now abandoned.

FIELD OF INVENTION

This invention relates to hygienically improving one's grip on a ball or device which is handled. More particularly this invention relates to an arm band, having a moist portion therein, with which one can moisten their finger tips on. The arm band is worn on an arm opposite to a hand used to grip, hold, and throw the ball.

BACKGROUND OF THE INVENTION

The transmission of infectious diseases among athletes in competitive sports has been known to be a problem for many years. Infectious agents are predominantly viruses but also a variety of fungi and bacteria. The more recent existence of drug resistant viruses and bacteria has made the risk to individual athletes and the team a more serious cause for concern. There are known cases where HIV and AIDS have been transmitted between athletes while the athletes have been playing in the open. Such an occurrence is in no way comparable to an entire team losing a playoff due to key players being sidelined. The transmission of HIV marks the end not only of a career, but a life.

The inventor has identified an important avenue through which infectious agents, including HIV and AIDS, have significant potential to be transmitted between athletes. In sports a ball used in the game is frequently handled by all athletes. Any individual who has wiped blood from an injury, or who has coughed because of lung irritation, has likely transferred infectious agents to the game ball. Within minutes several other players will successively handle that same infected ball.

In many sports, including football, baseball, and basketball, it is common practice for athletes to lick their fingertips to improve their grip on the game ball. Contact between the fingertips and tongues not only transfers that particular athlete's germs to the ball, but additionally wipes the germ laden fingertips, which have handled the dirty ball, clean on the tongue!

OBJECTS AND STATEMENT OF INVENTION

It is an object of this invention to disclose an apparatus which will reduce the transmission of infectious diseases between athletes. It is an object of this invention to disclose an apparatus which will eliminate any need for an athlete to wet his finger tips orally, or with his mouth, to improve his grip. It is yet a further object of this invention to disclose a ball gripping apparatus which may be conveniently and safely worn, even in a contact sport. It is a final object of this invention to disclose an apparatus which is adequate, and which can be economically assembled from generally available components.

One aspect of this invention provides for a method of improving finger grip comprises the following steps: a) providing a rigid water tight enclosure having a generally flat top and bottom side portion and peripheral upright sidewall portions extending around and between the top and bottom side portions; said top portion having an large central opening therethrough; b) positioning an absorbent material within the enclosure; c) providing a retention means to maintain the absorbent material positioned within the enclosure; d) positioning the enclosure within an elasticized band; e) wetting the absorbent material; f) positioning the band around one's arm; and, g) moistening one's fingertips through the central opening on the moist material prior to gripping with the fingers. The wetted absorbent material is largely protected in collisions and prevented from drying by the enclosure.

In a preferred aspect of the above invention the pan is made from a flexible resilient plastic and has an inwardly turned top rim on the top portion of the pan.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 1:
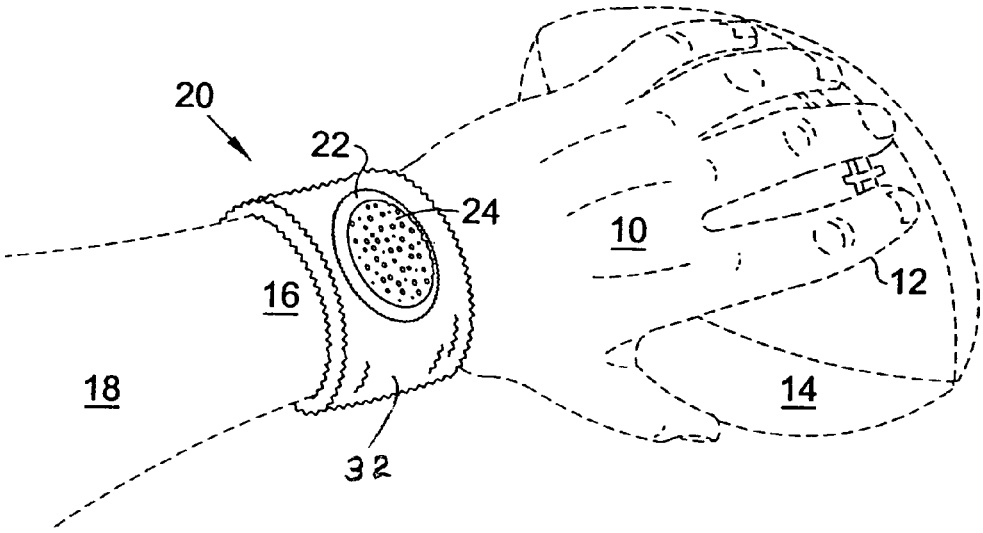
FIG. 1 is a perspective view of an athlete 18 wearing a gripping band 16 on his left wrist.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
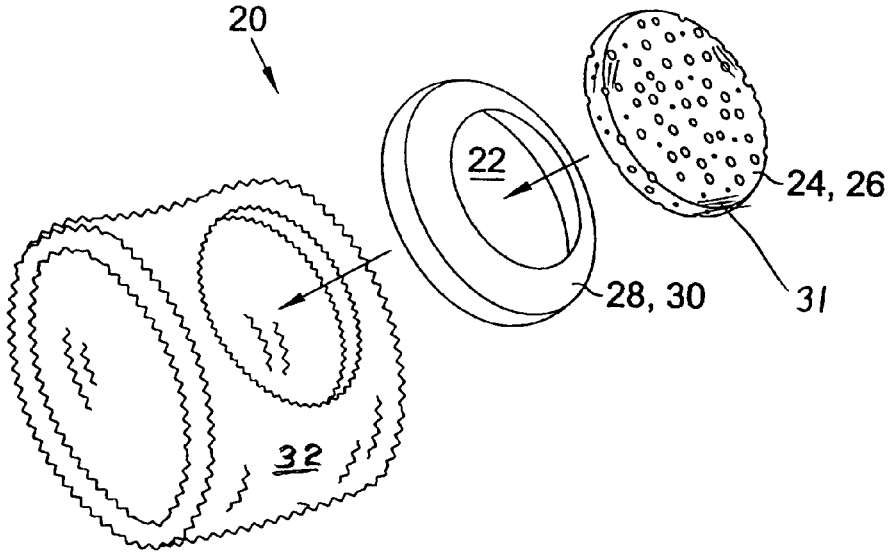
FIG. 2 is an exploded perspective view of the gripping band shown in FIG. 1.

Turning now to the drawings and more particularly to FIG. 1 we have a perspective view of an athlete 18 wearing a gripping band 20 on his left wrist 16. FIG. 2 is an exploded perspective view of the gripping band 20 shown in FIG. 1. A method of hygienically improving finger grip on an object such as a ball 14 comprises the following steps: a) providing a rigid water tight enclosure 22 having a generally flat bottom portion, a top side portion, and peripheral upright sidewall portions extending around and between the top and bottom side portions; said top portion having a large central opening therethrough; b) positioning an absorbent material 24 within the enclosure 22; c) providing a retention means 28 to maintain the absorbent material 24 positioned generally non-rotatably within the enclosure 22; d) positioning the enclosure 22 within an elasticized band 32; e) wetting the absorbent material 24; f) positioning the band 32 around one's arm 18; and, g) moistening one's fingers 12 through the central opening on the moist absorbent material 24 prior to gripping with the fingers 12. The wetted absorbent material is largely protected in collisions and prevented from drying by the enclosure.

Most preferably the pan 22 is made from a flexible resilient plastic. Within this application plastic is defined to include any type of rubber. The absorbent material 24 most preferably comprises a sponge 26. In the most preferred embodiment of the invention the retention means 28 solely comprises the top side portion 30 of the enclosure 22. In another aspect of the invention the retention means 28 comprises glue 31.

In the most preferred embodiment of the invention the elasticized band 32 is made from cotton. Alternatively, the elasticized band 32 could be made from any synthetic/cotton blend or synthetic material such as nylon. The band 32 could include a VELCRO™ attachment. The elasticized band 32 is sized to expand over a hand 10 and hold tightly on a wrist 16. The gripping band 20 would usually be worn on a wrist 16 opposite the throwing hand 10 so that the fingers could be moistened thereon without removing the gripping band from the wrist 16.

In yet another aspect of the invention the pan 22 and the elasticized band 32 are integrally formed from a flexible resilient plastic. As in the most preferred embodiment described immediately above the gripping band 20 is generally soft and flexible and when impacted can not injure either the wrist 16 of the athlete 18 wearing the gripping band 20, nor the athlete who impacted the gripping band 20.

Most preferably the enclosure 22 is made from a flexible resilient plastic which is generally non-rotatable within the griping band 32. The enclosure 22 may be removable from and replaceable in the elasticized band 32.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

We claim:

1. A method of improving finger grip of an athlete comprises the following steps:

a) providing a flexible semi-rigid water tight enclosure having a generally flat top and bottom side portion and peripheral upright sidewall portions extending around and between the top and bottom side portions;

said top portion having a large central top opening therethrough;

b) positioning an absorbent material having a front face within the enclosure so that the only portion of the absorbent material which is potentially exposed to drying is that relatively small portion of the front face exposed through the top opening, thereby minimizing the potential rate of drying of the absorbent material;

c) providing a retention means to maintain the absorbent material firmly and non-rotatably operatively positioned within the enclosure;

d) positioning the enclosure within an elasticized band so that the enclosure can be reliably non-rotatably and non-slidingly held on varying sizes of arm portions of different users even when impacted from any direction;

e) wetting the absorbent material;

f) positioning the band around one's arm; and, g) moistening one's fingertips on the absorbent material exposed within the central opening prior to gripping with the fingers;

so that, the athlete can hygienically, safely and conveniently improve his grip without orally wetting his fingers; the wetted absorbent material is largely protected from drying by the enclosure for sustained periods of time in any orientation; and the enclosure itself is not a potential source of injury even in collisions in a contact sport.

2. A method as in claim 1 wherein improved gripping is desired in a ball handling game.

3. A method as in claim 2 wherein the retention means solely comprises the top side portion of the enclosure.

4. A method as in claim 3 wherein the absorbent material comprises a sponge so that the sponge can be removed for cleaning and/or replacement.

5. A method as in claim 3 wherein the elasticized band is made from cotton.

6. A method as in claim 5 wherein the elasticized band is sized to expand over a hand and hold tightly on a wrist.

7. A method as in claim 3 wherein the enclosure and the elasticized band are integrally formed from resilient plastic.

8. A method as in claim 4 where a side portion of the absorbent material is glued to the enclosure.

9. A method as in claim 8 wherein the enclosure is made from a flexible resilient plastic so that it conforms to the curvature around a wrist and wherein the enclosure is both removable from, and replaceable in, the elasticized band to facilitate washing and drying of the band.

10. A method as in claim 9 wherein the sponge is non-rotatable due to the peripheral wall further comprising a top lip which squeezes the sponge, and the enclosure itself bending to conform to a curvature of a user's wrist.

* * * * *